US007331189B2

(12) United States Patent
Yoshida et al.

(10) Patent No.: US 7,331,189 B2
(45) Date of Patent: Feb. 19, 2008

(54) COOLING DEVICE

(75) Inventors: Kazuhiro Yoshida, Aichi-ken (JP); Kazuyoshi Seki, Aichi-ken (JP); Akihiko Hirano, Aichi-ken (JP); Masahide Yatori, Aichi-ken (JP); Chiyoshi Toya, Aichi-ken (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 362 days.

(21) Appl. No.: 10/995,110

(22) Filed: Nov. 24, 2004

(65) Prior Publication Data

US 2006/0107671 A1 May 25, 2006

(51) Int. Cl.
*F25D 21/06* (2006.01)
*F25B 41/00* (2006.01)
*F25B 49/00* (2006.01)

(52) U.S. Cl. ..... 62/151; 62/81; 62/196.4; 62/197; 62/509

(58) Field of Classification Search ..... 62/80, 62/81, 151, 196.4, 197, 272, 509
See application file for complete search history.

(56) References Cited

U.S. PATENT DOCUMENTS 5,319,940 A * 6/1994 Yakaski ..... 62/617
6,644,066 B1 * 11/2003 Dolcich ..... 62/509

* cited by examiner

*Primary Examiner*—Marc Norman
(74) *Attorney, Agent, or Firm*—Cheng Law Group PLLC

(57) ABSTRACT

In a cooling system having a compressor for supplying refrigerant under pressure, a condenser for condensing the refrigerant supplied from the compressor, a liquid receiver arranged to temporarily store the condensed refrigerant supplied from the condenser, an expansion valve for expanding the refrigerant supplied from the liquid receiver, and an evaporator arranged to effect evaporation of the expanded refrigerant for cooling the surrounding thereof, a bypass conduit is arranged to bypass the liquid receiver and expansion valve, and an electrically operated flow passage changeover valve is provided to selectively connect a supply passage of refrigerant to the liquid receiver and expansion valve and to the bypass conduit so that the supply passage of refrigerant is connected to the liquid receiver and expansion valve during operation at a cooling mode and is connected to the bypass conduit during operation at a defrost mode.

6 Claims, 5 Drawing Sheets

COOLING DEVICE

BACKGROUND OF THE INVENTION

1. Field of the Invention

The present invention relates to a cooling system adapted to an ice making machine, a refrigerator, a freezer, an air conditioner and the like, more particularly to a cooling system which is operated alternately at a cooling mode and a defrost mode.

2. Discussion of the Prior Art

A conventional cooling system of this kind comprises a compressor for supplying refrigerant under pressure, a condenser for cooling and condensing the refrigerant supplied from the compressor, a liquid receiver arranged to temporarily store the condensed refrigerant supplied from the condenser, an expansion valve for expanding the refrigerant supplied from the liquid receiver, and an evaporator arranged to effect evaporation of the expanded refrigerant for cooling the surrounding thereof. In the cooling system, a supply conduit of the refrigerant from the compressor to the condenser and a supply conduit of the refrigerant from the expansion valve to the evaporator are connected at their intermediate portions by means of a separate conduit to directly supply the refrigerant from the compressor to the evaporator during operation at a defrost mode thereby to heat the evaporator.

In the case that the compressor was installed at a place near the evaporator in the cooling system, noises in operation of the compressor and decrease of the cooling efficiency of the evaporator caused by exhaust heat of the compressor were problems for solution. If the compressor was installed at a place apart from the evaporator to solve the problems in the cooling system, the defrost conduit for direct supply of the refrigerant from the compressor to the evaporator would be elongated, resulting in an increase of cost of the component parts and cost for installation of the cooling system. Particularly, in the case that the evaporator is installed indoor while the compressor is installed outdoor, it is required to provide a separate conduit for connection of the indoor unit and the outdoor unit. If the conduit for defrost was elongated, a large amount of refrigerant would be required for the entirety of piping in the cooling system. If the refrigerant was insufficient in amount, the efficiency of cooling and defrosting in operation would be decreased.

SUMMARY OF THE INVENTION

It is, therefore, an object of the present invention to provide a cooling system at a low cost, wherein the compressor is installed at an appropriate place apart from the evaporator in such a manner capable of avoiding a decrease of the cooling and defrosting efficiency caused by shortage of refrigerant and of avoiding a decrease of the cooling efficiency of the evaporator caused by exhaust heat of the compressor.

According to the present invention, the object is accomplished by providing a cooling system having a compressor for supplying refrigerant under pressure, a condenser for cooling and condensing the refrigerant supplied from the compressor, a liquid receiver arranged to temporarily store the condensed refrigerant supplied from the condenser, an expansion valve for expanding the refrigerant supplied from the liquid receiver, and an evaporator arranged to effect evaporation of the expanded refrigerant for cooling the surrounding thereof, wherein the cooling system comprises a bypass conduit arranged to bypass the liquid receiver and expansion valve and flow passage changeover means electrically controlled to selectively connect a supply passage of the refrigerant to the liquid receiver and expansion valve and to the bypass conduit so that the supply passage of refrigerant is connected to the liquid receiver and expansion valve during operation at a cooling mode and is connected to the bypass conduit during operation at a defrost mode.

In the cooling system constructed as described above, the compressor can be installed at an appropriate place apart from the evaporator without the provision of any elongated conduit for defrost. Accordingly, the cooling system can be provided in such a manner as to avoid decrease of the cooling and defrosting efficiency caused by shortage of refrigerant, problems caused by noises of the compressor and decrease of the cooling efficiency of the evaporator caused by exhaust heat of the compressor.

Accordingly to an aspect of the present invention, there is provided a cooling system having a compressor for supplying refrigerant under pressure, a condenser for cooling and condensing the refrigerant supplied from the compressor, a liquid receiver arranged to temporarily store the condensed refrigerant supplied from the condenser, an expansion valve for expanding the refrigerant supplied from the liquid receiver, and an evaporator arranged to effect evaporation of the expanded refrigerant for cooling the surrounding thereof, wherein the cooling system comprises a bypass conduit arranged to bypass the expansion valve and flow passage changeover means electrically controlled to selectively connect the supply passage of refrigerant to the expansion valve and to the bypass conduit so that the supply passage of refrigerant is connected to the expansion valve during operation at a cooling mode and is connected to the bypass conduit during operation at a defrost mode.

In the cooling system described above, it is able to avoid decrease of the cooling and defrosting efficiency caused by shortage of refrigerant, problems caused by noises of the compressor and decrease of the cooling efficiency of the evaporator caused by exhaust heat of the compressor. As the refrigerant from the liquid receiver is supplied to the evaporator through the bypass conduit during operation at the defrost mode, the refrigerant stored in the liquid receiver can be utilized without uselessness to enhance the defrost efficiency.

DESCRIPTION OF THE PREFERRED EMBODIMENTS

First Embodiment

Figure 1:
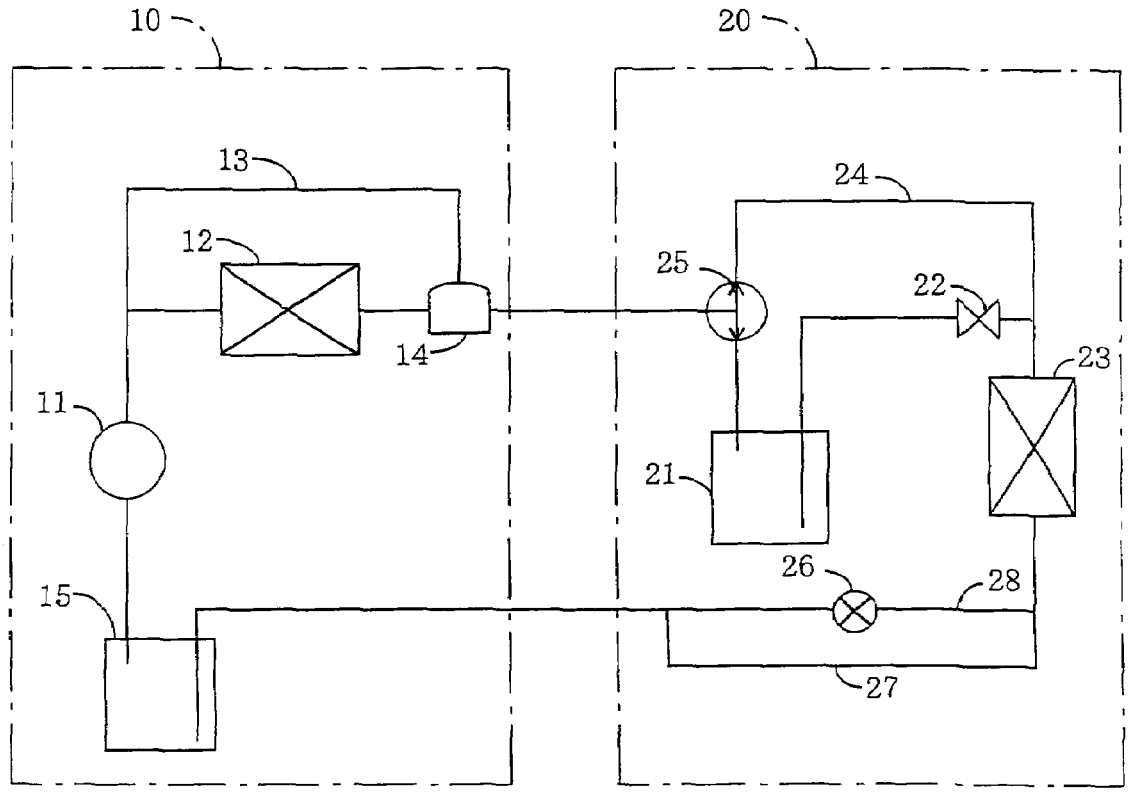
FIG. 1 is a block diagram of a cooling system in a first embodiment of the present invention.

Hereinafter, a first embodiment of the present invention will be described with reference to the drawings. In this embodiment, a cooling system according to the present invention is adapted to an ice making machine. As shown in FIG. 1, the cooling system comprises an outdoor unit 10 and an indoor unit 20. The outdoor unit 10 is composed of a compressor 11 for supplying refrigerant under pressure, a condenser 12 for condensing the refrigerant supplied from the compressor 11. The indoor unit 20 is composed of a liquid receiver 21 installed to temporarily store the condensed refrigerant supplied from the condenser 12, an expansion valve 22 placed to expand the condensed refrigerant supplied from the liquid receiver 21 and an evaporator 23 arranged to evaporate the expanded refrigerant from the expansion valve 22.

The outdoor unit 10 further comprises a bypass conduit 13 arranged to bypass the condenser 12 and a pressure adjustment valve 14 provided to maintain the pressure of refrigerant in a predetermined value at downstream of condenser 12. When the pressure at the downstream of condenser 12 becomes smaller than the predetermined value, the pressure adjustment valve 14 opens the bypass conduit 13 to supply a portion of refrigerant from the compressor 11 to the indoor unit 20. When the pressure at the downstream of condenser 12 becomes larger than the predetermined value, the pressure adjustment valve 14 closes the bypass conduit 13 to supply all the refrigerant from the condenser 12 to the indoor unit 20 therethrough. The outdoor unit 10 comprises a liquid separator 15 provided to remove a liquid portion from the refrigerant returned from evaporator 23.

The indoor unit 20 includes the liquid receiver 21, a bypass conduit 24 arranged to bypass the expansion valve 22 and flow passage changeover means in the form of a three-way valve 25. The three-way valve 25 has an inlet port connected to the condenser 12 through the pressure adjustment valve 14, a first outlet port in connection to the liquid receiver 21, and a second outlet port in connection to the bypass conduit 24. The three-way valve 25 is electrically controlled to selectively connect the supply passage of refrigerant from the compressor 11 of outdoor unit 10 to the liquid receiver 21 and to the bypass conduit 24.

The indoor unit 20 includes an on-off valve 26 and a return conduit 27 of small diameter as flow rate control means which restrain the flow quantity of refrigerant out of the evaporator 23 in operation at a defrost mode. The on-off valve 26 is disposed in a return conduit 28 circulating the refrigerant from evaporator 23 to the compressor 11 through the liquid separator 15. The on-off valve 26 is electrically controlled to permit the flow of refrigerant passing therethrough when it is opened and to interrupt the flow of refrigerant when it is closed. The return conduit 27 of small diameter is formed smaller in diameter than the return conduit 28 to provide a bypass passage of the on-off valve 26.

In the cooling system as described above, operation at a cooling mode and operation at a defrost mode are alternately repeated. In operation at the cooling mode, the three-way valve 25 is positioned to connect the supply passage of refrigerant to the liquid receiver 21 and expansion valve 22, while the on-off valve 26 is retained in an open condition. In such an instance, the refrigerant under pressure from compressor 11 is condensed by condenser 12, supplied to the liquid receiver 21 through three-way valve 25 and temporarily stored in the liquid receiver 21, expanded by expansion valve 22, and evaporated to cool the water surrounding the evaporator 23 so that an amount of ice is formed on the surface of evaporator 23. During such operation, the pressure adjustment valve 14 is operated to open the bypass conduit 13 thereby to maintain the pressure at the downstream of condenser 12 at the predetermined value.

In operation at the defrost mode, the three-way valve 25 is operated to switchover the supply passage of refrigerant from the liquid receiver 21 to the bypass conduit 24, while the on-off valve 26 is closed. In such an instance, the refrigerant under pressure from compressor 11 is supplied to the evaporator 23 through the bypass conduit 24 without passing through the liquid receiver 21 and expansion valve 22. Thus, the evaporator 23 is heated to release the ice formed thereon. When the pressure of refrigerant is decreased by bypass of the expansion valve 22 during operation at the defrost mode, the pressure adjustment valve 14 is operated to open the bypass conduit 13. Accordingly, the refrigerant under pressure from compressor 11 is supplied to the indoor unit 20 through the bypass conduit 13 and pressure adjustment valve 14 without being condensed by condenser 12. As the on-off valve 26 is maintained in its closed condition, the refrigerant out of evaporator 23 is circulated into the outdoor unit 10 through the return conduit 27 of small diameter in such a manner that the flow quantity of refrigerant is restrained.

As is understood from the above description, the indoor unit 10 and outdoor unit 20 in the cooling system are connected by only two conduits without the provision of another elongated conduit for defrosting, and the compressor 11 can be installed at an appropriate place apart from the evaporator 23. This is useful to avoid decrease of cooling and defrosting efficiency at a low cost and to avoid problems caused by noises of compressor 11 and decrease of cooling efficiency of the evaporator 23 caused by exhaust of compressor 11.

When the mode of operation in the cooling system is switched over, the three-way valve 25 is operated to switch over the supply passage of refrigerant from the side of liquid receiver 21 and expansion valve 22 to the side of bypass conduit 24. As a result, the refrigerant under pressure from compressor 11 is reliably supplied to the evaporator 23 through the bypass conduit 24 during operation at the defrost mode without causing any reverse flow of refrigerant remained in the liquid receiver 21. This is effective to enhance the defrost efficiency.

It is also noted that in operation at the defrost mode, the on-off valve 26 is closed to restrain the flow quantity of refrigerant out of evaporator 23 thereby to avoid excessive decrease of the pressure of refrigerant in evaporator 23 and re-evaporation of the refrigerant in evaporator 23 for enhancement of the defrost efficiency. During operation at the defrost mode, the pressure adjustment valve 14 is operated to open the bypass conduit 13 so that the refrigerant under pressure from compressor 11 is directly supplied to the indoor unit 20 without being condensed by the condenser 12 for enhancement of the defrost efficiency.

Second Embodiment

Figure 2:
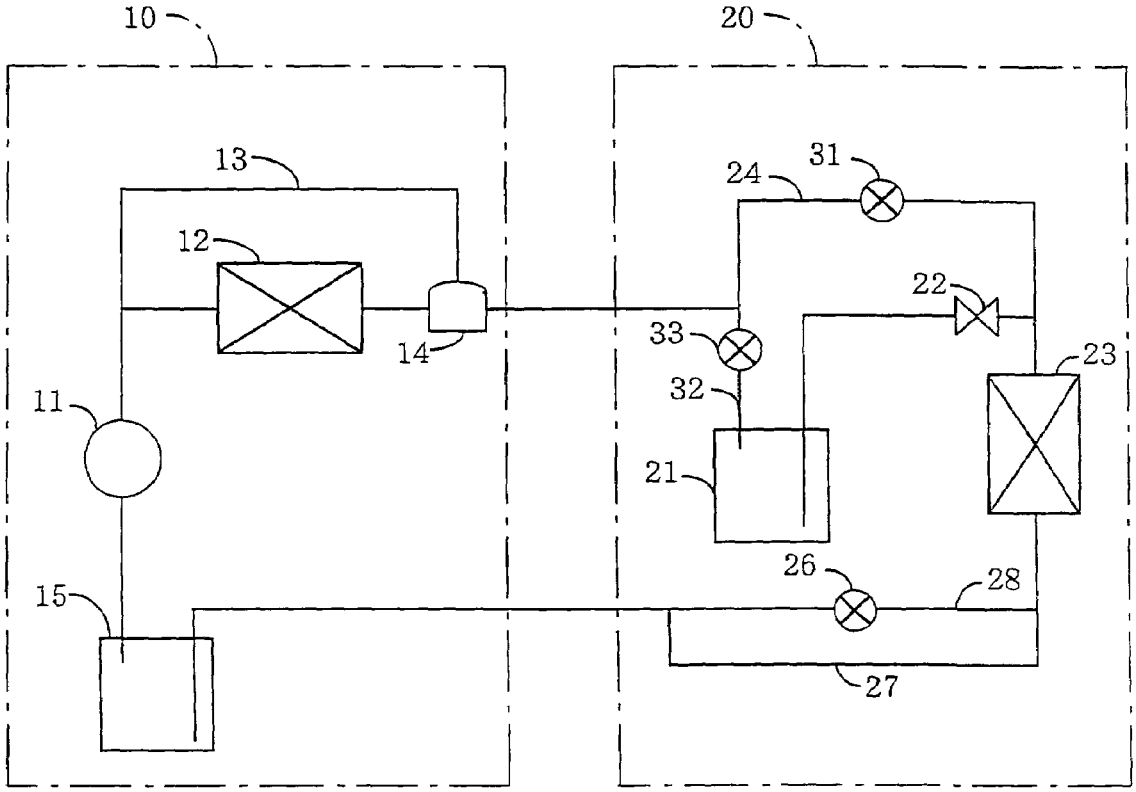
FIG. 2 is a block diagram of a cooling system in a second embodiment of the present invention.

Hereinafter, a second embodiment of the present invention will be described with reference to the drawings. In this second embodiment, as shown in FIG. 2, the three-way valve 25 in the first embodiment is replaced with an on-off valve 31, and an on-off valve 33 is disposed in a conduit 32 for supply of the refrigerant into the liquid receiver 21.

The on-off valve 31 is disposed in the bypass conduit 24 to be electrically controlled in operation of the system. In operation at the cooling mode, the on-off valve 31 is maintained in a closed condition to interrupt the flow of refrigerant passing through the bypass conduit 24. In operation at the defrost mode, the on-off valve 31 is opened to permit the flow of refrigerant passing through the bypass conduit 24. Thus, when the on-off valve 31 is closed during operation at the cooling mode, the refrigerant under pressure from compressor 11 is supplied to the side of liquid receiver 21 and expansion valve 22. When the on-off valve 31 is opened in operation at the defrost mode, the refrigerant under pressure from compressor 11 is supplied to the bypass conduit 24.

The on-off valve 33 is electrically controlled to permit the flow of refrigerant passing therethrough when it is opened during operation at the cooling mode and to interrupt the flow of refrigerant passing therethrough when it is closed during operation at the defrost mode. Thus, as in the first embodiment, the on-off valve 33 is useful to avoid a reverse flow of refrigerant remained in the liquid receiver during operation at the defrost mode for enhancement of defrost efficiency.

Third Embodiment

Figure 3:
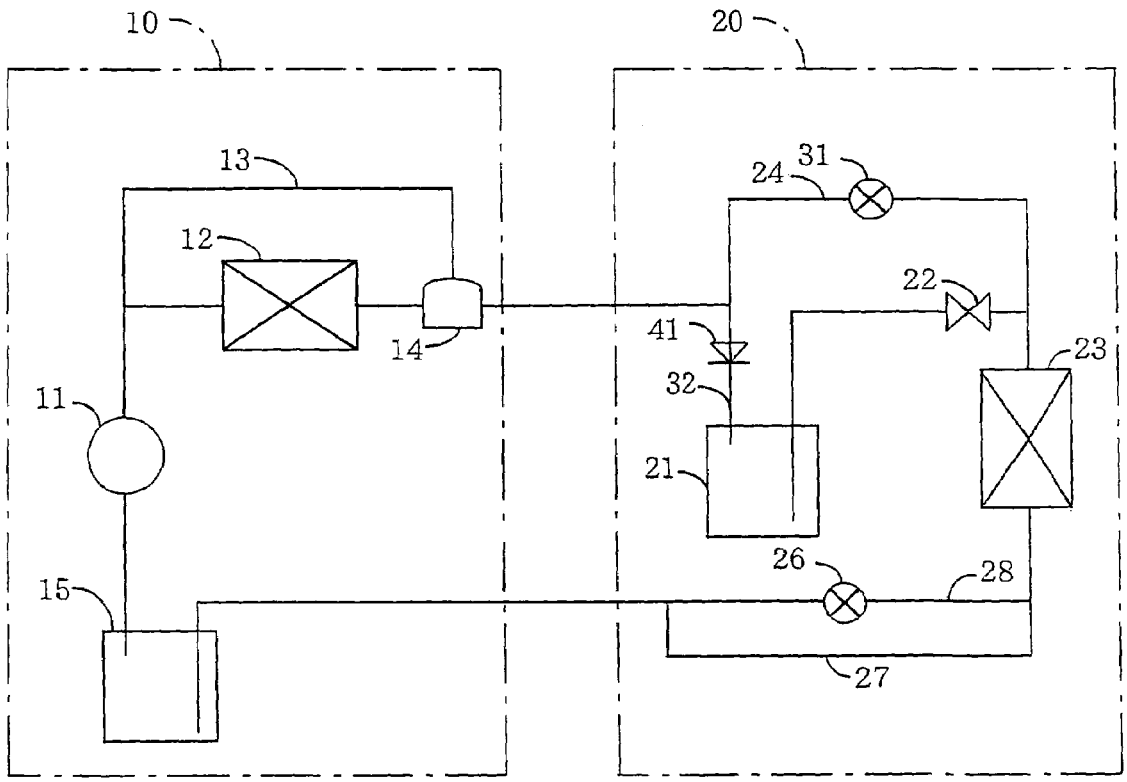
FIG. 3 is a block diagram of a cooling system in a third embodiment of the present invention.

Hereinafter, a third embodiment of the present invention will be described with reference to the drawings. In this third embodiment, as shown in FIG. 3, the on-off valve 33 in the second embodiment is replaced with a check valve 41 disposed in the conduit 32 for connection to the liquid receiver 21. The check valve 41 permits the flow of refrigerant from the condenser 12 and interrupts the flow of refrigerant from the liquid receiver 21. Thus, the check valve 41 is useful to avoid a reverse flow of refrigerant remained in the liquid receiver 21 during operation at the defrost mode.

Fourth Embodiment

Figure 4:
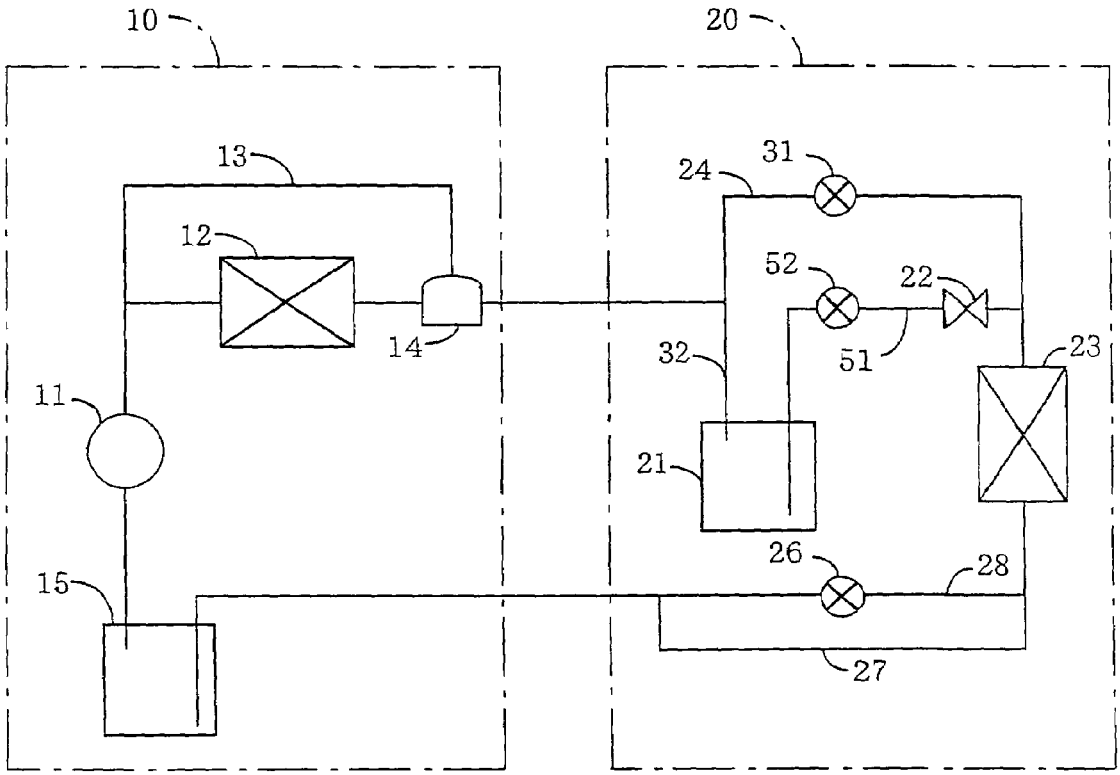
FIG. 4 is a block diagram of a cooling system in a fourth embodiment of the present invention.

Hereinafter, a fourth embodiment of the present invention will be described with reference to the drawings. In this fourth embodiment, as shown in FIG. 4, the on-off valve 33 in the second embodiment or the check valve 41 in the third embodiment is replaced with an on-off valve 52 disposed in a conduit 51 for supplying the refrigerant from the liquid receiver 21 to the expansion valve 22.

The on-off valve 52 is electrically controlled to permit the flow of refrigerant passing therethrough when it is maintained in an open condition during operation at the cooling mode and to interrupt the flow of refrigerant when it is maintained in a closed condition during operation at the defrost mode. In operation at the defrost mode, the on-off valve 52 interrupts the flow of refrigerant from an opposite side to the expansion valve 22 to reliably supply the refrigerant from compressor 11 to the evaporator 23. Accordingly, the evaporator 23 is heated by refrigerant of saturated temperature lower than the temperature of refrigerant supplied from compressor 11. This is useful to reduce a difference in temperature among refrigerants supplied to the respective parts for enhancing the durability of the cooling system and to avoid excessive melting of the ice for enhancing the quality of ice.

Fifth Embodiment

Figure 5:
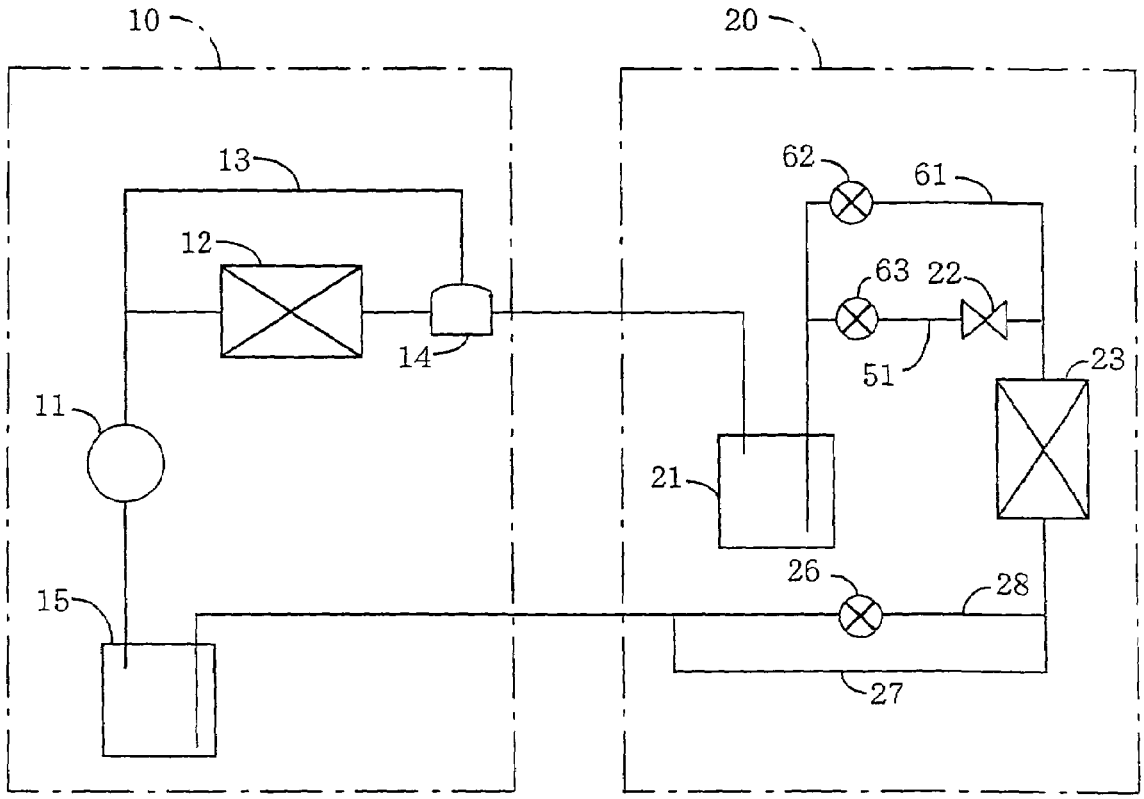
FIG. 5 is a block diagram of a cooling system in a fifth embodiment of the present invention.

Hereinafter, a fifth embodiment of the present invention will described with reference to the drawings. In this fifth embodiment, as shown in FIG. 5, the bypass conduit 24 in the foregoing embodiments is replaced with a bypass conduit 61 arranged to bypass the expansion valve 22. An on-off valve 62 disposed in the bypass conduit 61 is electrically controlled to interrupt the flow of refrigerant passing through the bypass conduit 61 when it is closed in operation at the cooling mode and to permit the flow of refrigerant passing through the bypass conduit 61 when it is opened in operation at the defrost mode. With the provision of on-off valve 62, the refrigerant under pressure from compressor 11 is supplied to the expansion valve 22 during operation at the cooling mode and is supplied to the bypass conduit 61 during operation at the defrost mode.

An on-off valve 63 disposed in the conduit 51 for supplying the refrigerant from the liquid receiver 21 to the expansion valve 22 is electrically controlled to permit the flow of refrigerant passing therethrough when it is maintained in an open condition during operation at the cooling mode and to interrupt the flow of refrigerant passing therethrough when it is maintained in a closed condition during operation at the defrost mode. With the provision of on-off valve 63, the flow of refrigerant from an opposite side to the expansion valve 22 is interrupted during operation at the defrost mode so that the refrigerant under pressure from compressor 11 is reliably supplied to the evaporator 23.

As in the first to fourth embodiments, the compressor 11 in this embodiment can be installed at an appropriate place apart from the evaporator 23 without the provision of any elongated conduit for defrosting. This is useful to avoid decrease of cooling and defrosting efficiency at a low cost and to avoid problems caused by noises of compressor 11 and decrease of cooling efficiency of the evaporator 23 caused by exhaust heat of compressor 11. Particularly, during operation at the defrost mode in this embodiment, the refrigerant from liquid receiver 23 is supplied to the evaporator 23 through the bypass conduit 61. This is useful to use the refrigerant stored in the liquid receiver 23 without uselessness for enhancement of the defrost efficiency.

Although the on-off valve 62 has been adapted as a flow passage changeover means in the above embodiment, a three-way valve may be adapted to switch over the supply passage of refrigerant from the side of conduit 63 and expansion valve 22 to the side of bypass conduit 61. In such a case, the on-off valve 63 may be removed.

Although the on-off valve 26 and return conduit 27 of small diameter have been adapted as flow quantity restraint means in the foregoing embodiments, a pressure reduction valve and a vapor pressure adjustment valve may be adapted as the flow quantity restraint means.

What is claimed is:

1. A cooling system composed of an outdoor unit comprising a compressor for supplying refrigerant under pressure and a condenser for cooling and condensing the refrigerant supplied from the compressor, and an indoor unit comprising a liquid receiver arranged to temporarily store the condensed refrigerant supplied from the condenser, an expansion valve for expanding the refrigerant supplied from the liquid receiver and an evaporator arranged to effect evaporation of the expanded refrigerant for cooling the surrounding thereof, wherein the indoor unit comprises a bypass conduit arranged to bypass the liquid receiver and expansion valve and flow passage changeover means electrically controlled to selectively connect a supply passage of refrigerant to the liquid receiver and expansion valve and to the bypass conduit so that the supply passage of refrigerant is connected to the liquid receiver and expansion valve during operation at a cooling mode and is connected to the bypass conduit during operation at a defrost mode, and wherein said flow passage changeover means is in the form of a three-way valve having an inlet port connected to the condenser, a first outlet port for connection to the liquid receiver, and a second outlet port for connection to the bypass conduit.

2. A cooling system as set forth in claim 1, wherein a flow quantity restraint means is provided in the form of an electrically operated on-off valve disposed in a return conduit of refrigerant from the evaporator to the compressor to permit the flow of refrigerant passing therethrough when it is opened and to interrupt the flow of refrigerant passing therethrough when it is closed and a bypass conduit of small diameter arranged to bypass the on-off valve.

3. A cooling system composed of an outdoor unit comprising a compressor for supplying refrigerant under pressure and a condenser for cooling and condensing the refrigerant supplied from the compressor, and an indoor unit comprising a liquid receiver arranged to temporarily store the condensed refrigerant supplied from the condenser, an expansion valve for expanding the refrigerant supplied from the liquid receiver, and an evaporator arranged to effect evaporation of the expanded refrigerant for cooling the surrounding thereof, wherein the indoor unit comprises a bypass conduit arranged to bypass the liquid receiver and expansion valve, a first electrically operated on-off valve disposed in the bypass conduit to permit the flow of refrigerant passing therethrough when it is opened during operation at a defrost mode and to interrupt the flow of refrigerant passing therethrough when it is closed during operation at a cooling mode, and a second electrically operated on-off valve disposed in a supply conduit of the refrigerant to the liquid receiver to permit the flow of refrigerant passing therethrough when it is opened during operation at the cooling mode and to interrupt the flow of refrigerant passing therethrough when it is closed during operation at the defrost mode, and wherein the supply conduit of the refrigerant in said indoor unit is connected to the condenser of said outdoor unit by means of a main conduit, while the evaporator of said indoor unit is connected to the compressor of said outdoor unit by means of a return conduit to circulate the refrigerant to the compressor.

4. A cooling system as set forth in claim 3, wherein a flow quantity restraint means is provided in the form of an electrically operated on-off valve disposed in a return conduit of refrigerant from the evaporator to the compressor to permit the flow of refrigerant passing therethrough when it is opened and to interrupt the flow of refrigerant passing therethrough when it is closed and a bypass conduit of small diameter arranged to bypass the on-off valve.

5. A cooling system composed of an outdoor unit comprising a compressor for supplying refrigerant under pressure and a condenser for cooling and condensing the refrigerant supplied from the compressor, and an indoor unit comprising a liquid receiver arranged to temporarily store the condensed refrigerant supplied from the condenser, an expansion valve for expanding the refrigerant supplied from the liquid receiver and an evaporator arranged to effect evaporation of the expanded refrigerant for cooling the surrounding thereof, wherein the indoor unit comprises a bypass conduit arranged to bypass the liquid receiver and expansion valve, a first electrically operated on-off valve disposed in the bypass conduit to permit the flow of refrigerant passing therethrough when it is opened during operation at a defrost mode and to interrupt the flow of refrigerant passing therethrough when it is closed during operation at a cooling mode, and a second electrically operated on-off valve disposed in a supply conduit of the refrigerant from the liquid receiver to the expansion valve to permit the flow of refrigerant passing therethrough when it is opened during operation at the cooling mode and to interrupt the flow of refrigerant passing therethrough when it is closed during operation at the defrost mode, and wherein the supply conduit of the refrigerant in said indoor unit is connected to the condenser of said outdoor unit by means of a main conduit, while the evaporator of said indoor unit is connected to the compressor of said outdoor unit by means of a return conduit to circulate the refrigerant to the compressor.

6. A cooling system composed of an outdoor unit comprising a compressor for supplying refrigerant under pressure and a condenser for cooling and condensing the refrigerant supplied from the compressor, and an indoor unit comprising a liquid receiver arranged to temporarily store the condensed refrigerant supplied from the condenser, an expansion valve for expanding the refrigerant supplied from the liquid receiver and an evaporator arranged to effect evaporation of the expanded refrigerant for cooling the surrounding thereof, wherein the indoor unit comprises a bypass conduit arranged to bypass the expansion valve, and flow passage changeover means electrically controlled to selectively connect a supply passage of refrigerant to the liquid receiver and expansion valve and to the bypass conduit so that the supply passage of refrigerant is connected to the expansion valve during operation at a cooling mode and is connected to the bypass conduit during operation at a defrost mode, and wherein a flow quantity restraint means is provided in the form of an electrically operated on-off valve disposed in a return conduit of refrigerant from the evaporator to the compressor to permit the flow of refrigerant passing therethrough when it is opened and to interrupt the flow of refrigerant passing therethrough when it is closed and a bypass conduit of small diameter arranged to bypass the on-off valve.

* * * * *